US011204139B2

(12) United States Patent
Ansems et al.

(10) Patent No.: US 11,204,139 B2
(45) Date of Patent: Dec. 21, 2021

(54) LIGHT EMITTING STRIP

(71) Applicant: SIGNIFY HOLDING B.V., Eindhoven (NL)

(72) Inventors: Johannes Petrus Maria Ansems, Hulsel (NL); Michel Cornelis Josephus Marie Vissenberg, Roermond (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/628,841

(22) PCT Filed: Jul. 3, 2018

(86) PCT No.: PCT/EP2018/067945
§ 371 (c)(1),
(2) Date: Jan. 6, 2020

(87) PCT Pub. No.: WO2019/011721
PCT Pub. Date: Jan. 17, 2019

(65) Prior Publication Data

US 2020/0132263 A1 Apr. 30, 2020

(30) Foreign Application Priority Data

Jul. 13, 2017 (EP) ..... 17181199

(51) Int. Cl.

| | |
|---|---|
| ***F21S 4/26*** | (2016.01) |
| ***F21K 9/90*** | (2016.01) |
| ***F21Y 103/10*** | (2016.01) |
| ***F21Y 115/10*** | (2016.01) |

(52) U.S. Cl.
CPC ..... *F21S 4/26* (2016.01); *F21K 9/90* (2013.01); *F21Y 2103/10* (2016.08); *F21Y 2115/10* (2016.08)

(58) Field of Classification Search
None
See application file for complete search history.

(56) References Cited

U.S. PATENT DOCUMENTS

| | | | | |
|---|---|---|---|---|
| 2010/0061095 | A1* | 3/2010 | Hoffmann | F21S 8/022 362/235 |
| 2010/0157584 | A1* | 6/2010 | Ho | F21S 4/00 362/223 |
| 2014/0098535 | A1* | 4/2014 | Smith | F21S 4/28 362/238 |

(Continued)

FOREIGN PATENT DOCUMENTS

| | | |
|---|---|---|
| CN | 203190289 U | 9/2013 |
| CN | 103712108 A | 4/2014 |

(Continued)

*Primary Examiner* — Britt D Hanley
(74) *Attorney, Agent, or Firm* — Daniel J. Piotrowski

(57) ABSTRACT

The present invention relates to a light emitting strip (10), comprising: an elongate body (12); at least one light source (16) adapted to emit light into the elongate body; and a gap (24) in the elongate body, which gap is arranged in front of the at least one light source, wherein the gap is adapted to omnidirectionally distribute, in a plane (26) perpendicular to a longitudinal direction of the light emitting strip, light emitted by the at least one light source. The present invention also relates to a method of manufacturing a light emitting strip (10).

7 Claims, 3 Drawing Sheets

(56) References Cited

U.S. PATENT DOCUMENTS

| | | | |
|---|---|---|---|
| 2015/0138752 | A1 | 5/2015 | Katona et al. |
| 2016/0334066 | A1 | 11/2016 | Yuan et al. |

FOREIGN PATENT DOCUMENTS

| | | | |
|---|---|---|---|
| CN | 203571513 | U | 4/2014 |
| CN | 105333338 | A | 2/2016 |
| CN | 205938678 | U | 2/2017 |
| GB | 2409024 | A | 6/2005 |
| JP | 2016522554 | A | 7/2016 |
| WO | 2005106320 | A1 | 11/2005 |
| WO | 2014063446 | A1 | 5/2014 |

* cited by examiner

LIGHT EMITTING STRIP

CROSS-REFERENCE TO PRIOR APPLICATIONS

This application is the U.S. National Phase application under 35 U.S.C. § 371 of International Application No. PCT/EP2018/067945, filed on Jul. 3, 2018, which claims the benefit of European Patent Application No. 17181199.5, filed on Jul. 13, 2017. These applications are hereby incorporated by reference herein.

FIELD OF THE INVENTION

The present invention relates to a light emitting strip, for example a light emitting diode (LED) strip. The present invention also relates to a method of manufacturing a light emitting strip.

BACKGROUND OF THE INVENTION

LED strips are available in a large variety. However, almost all of them have a one sided Lambertian luminous intensity distribution. In a lot of use cases this is very inconvenient, for example if the LED strip is free hanging instead of being mounted on a wall or ceiling.

US2014098535 relates to a segmented LED lighting system. In particular, US2014098535 discloses a set of channel segments connected by a flexible lens sleeve that can be positioned in a variety of ways. A printed circuit board with at least one LED is mounted in each channel segment. Each segment preferably has a base with two ribbed vertical sides. The lens sleeve is preferably coextruded from flexible acrylic and has opaque side grips that grip the ribbed vertical sides and a translucent lens portion with an air gap to help proper diffraction of the light along the length and width of the lens sleeve.

SUMMARY OF THE INVENTION

It is an object of the present invention to overcome or at least alleviate the aforementioned problem(s), and to provide an improved light emitting strip.

According to a first aspect of the invention, this and other objects are achieved by a light emitting strip, comprising: an elongate body; at least one light source adapted to emit light into the elongate body; and a gap in the elongate body, which gap is arranged in front of the at least one light source, wherein the gap is adapted to omnidirectionally distribute, in a plane perpendicular to a longitudinal direction of the light emitting strip, light emitted by the at least one light source.

The present invention is based on the understanding that a gap, for example an air gap, in the body of the strip may be shaped and/or positioned such that light from at least one light source, even if the light is emitted from the light source(s) in only one main direction, can be omnidirectionally distributed, i.e. distributed in basically all directions, in a plane perpendicular to the longitudinal direction of the light emitting strip.

By means of the present omnidirectional light emitting strip, the mounting direction of the strip becomes unimportant. Also, any twisting of the strip would not result in any visible effect. When for example the present light emitting strip is free hanging, it is possible and very favourable to get a homogenous light effect over the total length of the strip.

The gap may be arranged such that a first part of the light emitted by the at least one light source passes the gap and such that a second part of the light emitted by the at least one light source is reflected back towards a plane in which the at least one light source is situated but preferably not towards the at least one light source itself or towards any support for the at least one light source. This may be achieved by having a first interface between the elongate body and the gap, which first interface is proximal to the at least one light source and dual arches-shaped, and a second interface between the elongate body and the gap, which second interface is distal to the at least one light source. The second interface may be single arch-shaped. The second part may be reflected back by at least two total internal reflections at an interface between the elongate body and the gap, which interface for example may be the aforementioned first interface.

The at least one light source together with any support for the at least one light source may be arranged in the elongate body. For example, the at least one light source together with the support, if any, may be arranged in a space in the elongate body.

The elongate body may have a circular cross-section. The circular shape may beneficially match the omnidirectional lighting function; it has no preferred orientation and it does not change appearance when the lighting device is somewhat twisted.

The light emitting strip may further comprise an elongate diffuse outer part at least partly encircling the elongate body. The elongate diffuse outer part may homogenize the emitted light further and prevent a direct look on the at least one light source. The elongate diffuse outer part may have a further function to make the optical output insensitive to scratches and dirt, by smoothening out small artefacts. Instead of the elongate diffuse outer part, the elongate body could have a rough outer surface or a thin white coating.

The thickness of the elongate diffuse outer part may vary along the circumferential direction of the elongate diffuse outer part. The elongate diffuse outer part may for example the thicker in a main light emitting direction of the at least one light source and thinner in the opposite direction, to balance the asymmetry in case of top-emitting light sources.

The elongate diffuse outer part may comprise scattering particles, wherein the density of scattering particles varies along the circumferential direction of the elongate diffuse outer part. The density may for example be higher in a main light emitting direction of the at least one light source and lower in the opposite direction, to balance the asymmetry in case of top-emitting light sources.

The elongate body and the elongate diffuse outer part may be co-extruded. The elongate body and elongate diffuse outer part may hence collectively be referred to as a co-extruded or co-extrusion profile.

The gap may have a shape as illustrated in figures of the present application.

According to a second aspect of the invention, there is provided a method of manufacturing a light emitting strip, which method comprises: co-extruding a central elongate body and an elongate diffuse outer part; and providing at least one light source adapted to emit light into the elongate body, wherein a gap in the elongate body is arranged in front of the at least one light source, and wherein the gap is adapted to omnidirectionally distribute, in a plane perpendicular to a longitudinal direction of the light emitting strip, the light emitted by the at least one light source. This aspect may exhibit the same or similar features and technical effects as the first aspect, and vice versa.

It is noted that the invention relates to all possible combinations of features recited in the claims.

BRIEF DESCRIPTION OF THE DRAWINGS

These and other aspects of the present invention will now be described in more detail, with reference to the appended drawings showing embodiment(s) of the invention.

As illustrated in the figures, the sizes of layers and regions may be exaggerated for illustrative purposes and, thus, are provided to illustrate the general structures of embodiments of the present invention. Like reference numerals refer to like elements throughout.

DETAILED DESCRIPTION

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled person.

FIGS. 1 and 2*a-c* illustrate a light emitting strip 10 according to one or more embodiments to the present invention. The light emitting strip 10 may be a flexible omnidirectional light emitting diode (LED) strip. It is appreciated from the drawings and the following description that the light emitting strip 10 does not have to be flat. Instead, the light emitting strip 10 may (overall) be shaped like a rope or string.

Figure 1:
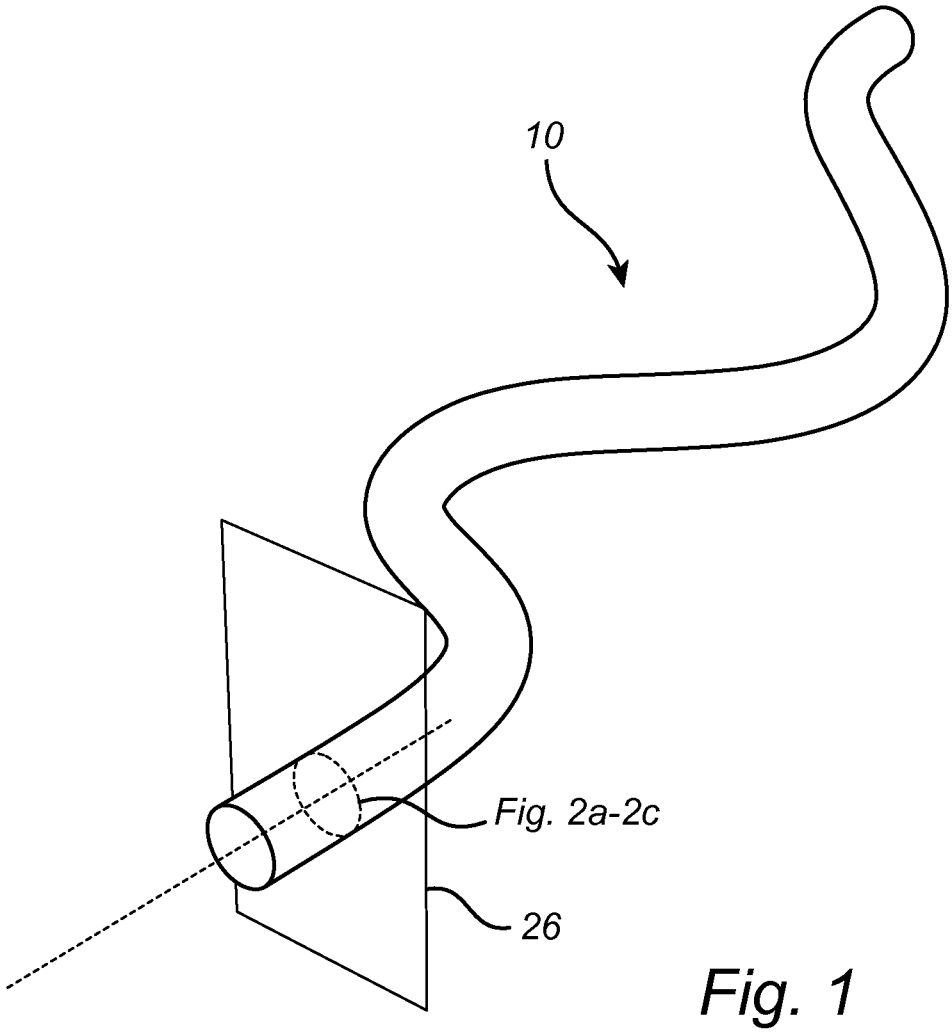
FIG. 1 is a perspective view of a light emitting strip according to one or more embodiments to the present invention.
Figure 2A:
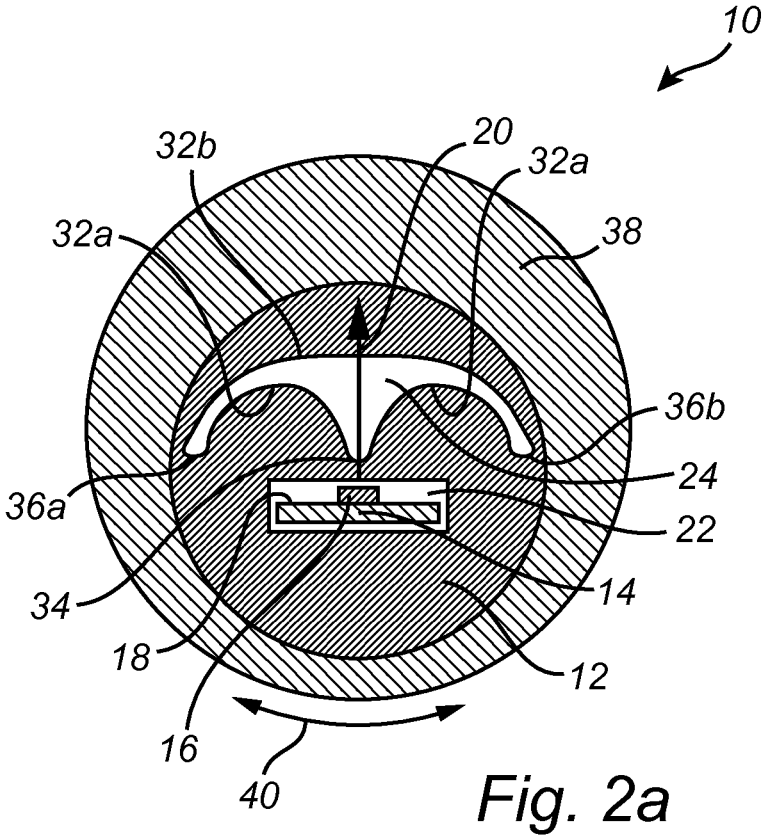
FIGS. 2*a-c* are cross-sectional views of the light emitting strip of FIG. 1, although the hatching is omitted in FIGS. 2*b-c* for brevity.
Figure 2B:
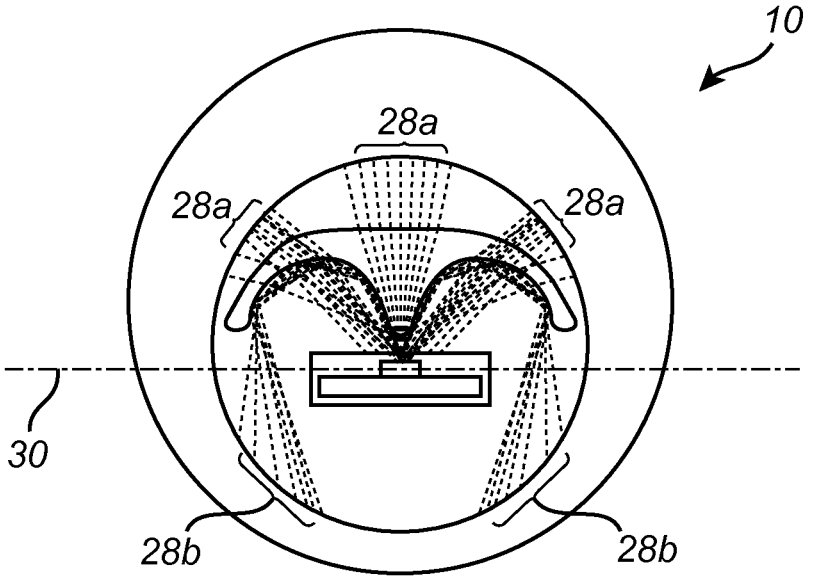
Figure 2C:
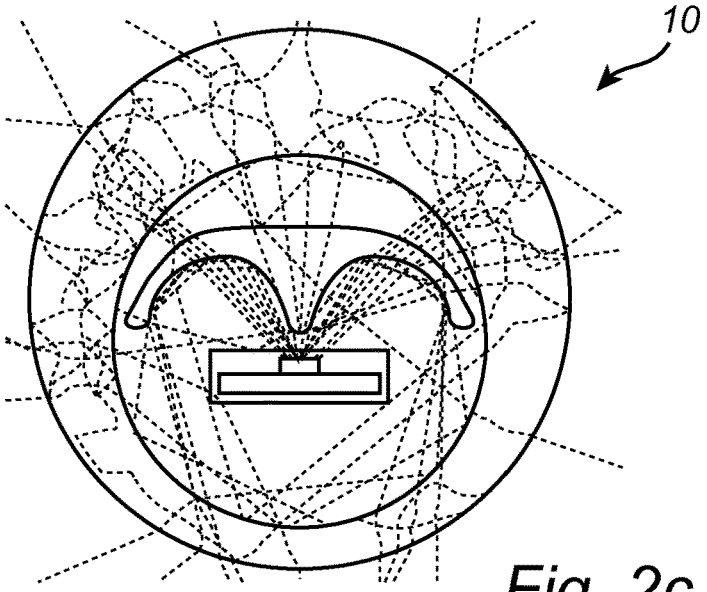

The light emitting strip 10 comprises a (central) elongate body 12. The elongate body 12 may for example have a length in the range of 1-10 m (for indoor applications) or 1-100 (for outdoor applications), which length may correspond to the overall length of the light emitting strip 10. The elongate body 12 may be flexible. The elongate body 12 may be transparent (clear) or somewhat translucent. The elongate body 12 may for example be made of or comprise silicone, thermoplastic elastomer (TPE), PVC, PMMA, or Polycarbonate. The elongate body 12 may have a circular cross-section perpendicular to the length of the elongate body 12, as seen in FIGS. 2*a-c*. In particular, the outer circumference of the elongate body 12 is circular. The diameter of the elongate body 12 may be in the range of 5-50 mm, typically in the range of 10-30 mm.

The light emitting strip 10 further comprises at least one but preferably several light sources 16 adapted to emit light into the elongate body 12. The light sources 16 may be mounted on an elongate support 14. The elongate support 14 may have (substantially) the same length as the elongate body 12. The elongate support 14 is here a flexible printed circuit, and the light sources 16 are light emitting diodes. The light sources 16 are positioned on one side 18 of the elongate support 14, and they may be mounted one after the other in the longitudinal direction of the elongate support 14. There is typically a distance between successive light sources 16. The light sources 16 may be facing the same direction. The light sources 16 may be top emitting devices having a main light emitting direction 20. The elongate support 14 and the light sources 16 may be arranged in an air-filled space 22 in the elongate body 12. The space 22 may for example have a rectangular shape, as seen in FIGS. 2*a-c*.

The at least one light source could alternatively be organic light emitting diodes or laser diodes mounted on the elongate support 14, or one strip-shaped light source for example a flexible electroluminescent strip or a flexible organic LED strip without separate support. Also, instead of being a flexible printed circuit, the elongate support 14 could be just wires or flat cable wires on which the light sources 16 are directly mounted, or a plurality of small rigid boards interconnected by a flexible mechanical and electrical connection.

The light emitting strip 10 further comprises a gap 24 in the elongate body 12 The gap 24 may have (substantially) the same length as the elongate body 12. The gap 24 may be referred to as an elongate gap. The gap 24 may be an air gap, or the gap 24 may be filled with a material with a lower index of refraction than the material of the elongate body 12. The gap 24 is arranged in front of the light sources 16, i.e. in the main light emitting direction 20 of the light sources 16. The gap 24 is generally adapted to omnidirectionally distribute—in a plane 26 perpendicular to a longitudinal direction of the light emitting strip 10—light emitted by the light sources 16. The gap 24 is shaped and positioned relative to the light sources 16 such that a first part 28*a* of the light emitted by the light sources 16 may pass the gap 24 and such that a second part 28*b* of the light emitted by the light sources 16 may be reflected back towards a plane 30 in which the light sources 16 are situated (see FIG. 2*b*), but not directly towards the elongate support 14 and the light sources 16. Namely, the light emitting strip 10 has first and second interfaces 32*a-b* between the elongate body 12 and the gap 24. The first interface 32*a* is proximal to the light sources 16, and the second interface 32*b* is distal to the light sources 16. Furthermore, the first interface 32*a* is dual arches-shaped, as seen in FIGS. 2*a-c*. That is, the first interface 32*a* has the shape of two arches, which are connected at an intermediate point 34. The intermediate point 34 may be positioned centrally over the light sources 16. The arches of the first interface 32*a* may be (semi-) circular, segmented, pointed, inverted V-shaped, etc. The second interface 32*b* is single arch-shaped, as seen in FIGS. 2*a-c*. That is, the first interface 32*a* has the shape of one arch, which arch connects with the outer points 36*a-b* of the two arches of the first interface 32*a*. The gap 24 should be wider than the at least one light source 16 (and the elongate support 14), so that as much as possible of the light reflected back can pass the at least one light source 16 (and the support 14). The shape of the gap 24 as seen in FIGS. 2*a-c*, as well as other shapes seen in those cross-sectional views, may be uniform throughout the length of the light emitting strip 10.

The aforementioned second part 28*b* may be at least 10% or at least 20% but preferably not more than 50% of the light emitted by the light source(s) 16 as seen in plane 26, whereas the first part 28*a* constitutes the rest of the light emitted by the light source(s) 16 in plane 26. The first part 28*a* may for example be 50% of the light emitted by the light source(s) 16 and the second part 28*b* is 50% of the light emitted by the light source(s) 16.

The light emitting strip 10 may further comprise an elongate diffuse outer part 38. The elongate diffuse outer part 38 may have (substantially) the same length as the elongate body 12. The elongate diffuse outer part 38 here completely encircles the elongate body 12, as seen in FIGS. 2*a-c*. The elongate diffuse outer part 38 may for example be made of or comprise the same material as the elongate body 12, i.e. silicone, thermoplastic elastomer (TPE), PVC, PMMA, or Polycarbonate. In FIGS. 2*a-c*, the thickness of the elongate diffuse outer 38 varies along the circumferential direction 40 of the elongate diffuse outer part 38. Namely, the elongate diffuse outer part 38 is thicker (=more diffusion) in the main light emitting direction 20 and thinner in the opposite direction, to balance the asymmetry of top-emitting light sources 16. The thickness in the main light emitting direction 20 may for example be in the range of 3-20 mm and the thickness in the opposite direction may be in the range of 0-5 mm or 0.5-5 mm. The thickness may for example vary between 10 mm (top) and 3 mm (bottom) or between 20 mm (top) and 1 mm (bottom). In case the elongate diffuse outer part 38 only partly encircles the elongate body 12, the thickness opposite the main light emitting direction 20 may be 0 mm.

Figure 3:
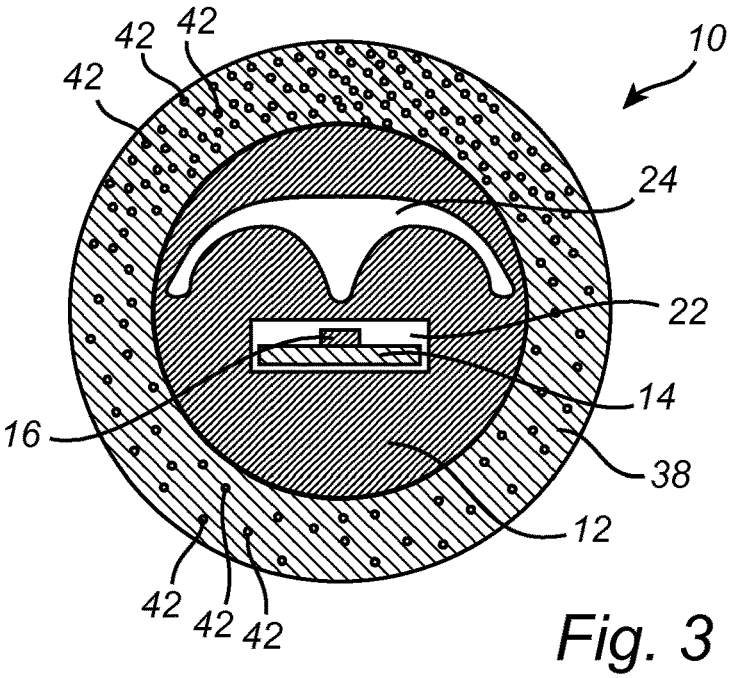
FIG. 3 is a cross-sectional view of a light emitting strip according to another embodiment of the present invention.

In another embodiment shown in FIG. 3, the elongate diffuse outer part 38 comprises scattering particles 42, for example white paint material (such as titanium oxide) or any clear material with a refractive index different than that of the remaining elongate diffuse outer part 38 (such as air bubbles, PC particles, PMMA particles, silicone, glass, etc.). The density of scattering particles 42 may vary along the circumferential direction 40. The density may for example be higher (=more scattering/diffusion) in the main light emitting direction 20 and lower in the opposite direction, to balance the asymmetry of top-emitting light sources 16. The thickness of the elongate diffuse outer 38 may in this embodiment be uniform along the circumferential direction 40.

In operation of the light emitting strip 10, the light sources 16 emit light, wherein some (first part 28*a*) of the light passes the gap 24, whereas some (second part 28*b*) of the light is reflected back towards the plane 30 by at least two total internal reflections at the first interface 32*a*, resulting in an omnidirectional luminous intensity distribution, as shown in FIG. 2*b*. That is, the gap 24 (re)distributes light emitted by light sources 16 uniformly along the circumference of the light emitting strip 10. The elongate diffuse outer part 38 further homogenizes the light, as shown in FIG. 2*c*.

Figure 4:
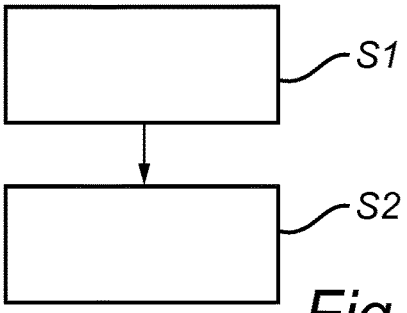
FIG. 4 is a flow chart of a method of manufacturing a light emitting strip according to one or more embodiments to the present invention.

FIG. 4 is a flow chart of a method of manufacturing the light emitting strip 10. The method comprises the steps of co-extruding (S1) the central elongate body 12 (including the space 22 and gap 24) and the elongate diffuse outer part 38, and providing (S2) the at least one light sources 16 adapted to emit light into the elongate body 12. The latter step may include inserting the elongate support 14 and/or the light source(s) 16 into the space 22 during or after the co-extruding step.

The light emitting strip 10 can be used indoors or outdoors, as a direct or indirect light source. The light emitting strip 10 may have enough light output to create the best ambiance, or for practical purposes like soft security and navigation lighting and architectural lighting.

The person skilled in the art realizes that the present invention by no means is limited to the preferred embodiments described above. On the contrary, many modifications and variations are possible within the scope of the appended claims.

Additionally, variations to the disclosed embodiments can be understood and effected by the skilled person in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage.

The invention claimed is:

1. A light emitting strip, comprising:

an elongate body;

at least one light source adapted to emit light into the elongate body; and a gap in the elongate body, wherein the gap is arranged in front of the at least one light source, wherein the gap is adapted to omnidirectionally distribute, in a plane perpendicular to a longitudinal direction of the light emitting strip, light emitted by the at least one light source and, wherein said light emitting strip has a first interface between the elongate body and the gap, wherein the first interface is proximal to the at least one light source and dual arches-shaped, and a second interface between the elongate body and the gap, wherein the second interface is distal to the at least one light source;

an elongate diffuse outer part at least partly encircling the elongate body, wherein the elongated diffuse outer part, (1) has a thickness that varies along the circumferential direction of the elongate diffuse outer part; or (2) comprises scattering particles, and wherein the density of scattering particles varies along the circumferential direction of the elongate diffuse outer part; or (3) is co-extruded with the elongate body.

2. A light emitting strip according to claim 1, wherein the gap is arranged such that a first part of the light emitted by the at least one light source passes through the gap and such that a second part of the light emitted by the at least one light source is reflected back towards a plane in which the at least one light source is situated but not towards the at least one light source itself or towards any support for the at least one light source.

3. A light emitting strip according to claim 1, wherein the second interface is single arch-shaped.

4. A light emitting strip according to claim 2, wherein the second part is reflected back by at least two internal reflections at first interface between the elongate body and the gap.

5. A light emitting strip according to claim 1, wherein the at least one light source together with any support for the at least one light source is arranged in the elongate body.

6. A light emitting strip according to claim 1, wherein the elongate body has a circular cross-section.

7. A method of manufacturing a light emitting strip, which method comprises:

extruding an elongate body; and providing at least one light source adapted to emit light into the elongate body, wherein a gap in the elongate body is arranged in front of the at least one light source, and wherein the gap is adapted to omnidirectionally distribute, in a plane perpendicular to a longitudinal direction of the light emitting strip, light emitted by the at least one light source and wherein the light emitting strip is having a first interface between the elongate body and the gap, which first interface is proximal to the at least one light source and dual arches-shaped, and a second interface between the elongate body and the gap, which second interface is distal to the at least one light source; and wherein the elongate diffuse outer part at least partly encircling the elongate body, wherein the elongated diffuse outer part, (1) has a thickness that varies along the circumferential direction of the elongate diffuse outer part; or (2) comprises scattering particles, and wherein the density of scattering particles varies along the circumferential direction of the elongate diffuse outer part; or (3) is co-extruded with the elongate body.

* * * * *